US008801043B2

(12) United States Patent
Hazen

(10) Patent No.: US 8,801,043 B2
(45) Date of Patent: Aug. 12, 2014

(54) PRINTER REGISTER HOLOGRAPHIC IMAGES

(75) Inventor: John Hazen, South Hadley, MA (US)

(73) Assignee: Hazen Paper Company, Holyoke, MA (US)

( * ) Notice: Subject to any disclaimer, the term of this patent is extended or adjusted under 35 U.S.C. 154(b) by 106 days.

(21) Appl. No.: 12/874,546

(22) Filed: Sep. 2, 2010

(65) Prior Publication Data

US 2011/0109949 A1 May 12, 2011

Related U.S. Application Data

(60) Provisional application No. 61/239,540, filed on Sep. 3, 2009.

(51) Int. Cl.

| | |
|---|---|
| ***B42D 15/00*** | (2006.01) |
| ***B41L 3/02*** | (2006.01) |
| ***B41L 3/08*** | (2006.01) |
| ***B44C 1/17*** | (2006.01) |
| ***A63F 3/06*** | (2006.01) |
| ***B42D 15/02*** | (2006.01) |

(52) U.S. Cl.

CPC ..... *B42D 15/02* (2013.01); *B42D 2031/30* (2013.01); *A63F 3/065* (2013.01); *B42D 2035/22* (2013.01); *B42D 2031/32* (2013.01); *B42D 2031/20* (2013.01); *A63F 2250/302* (2013.01); *A63F 3/0665* (2013.01); *Y10S 283/903* (2013.01)

USPC ..... 283/86; 101/485; 101/486; 156/235; 283/903

(58) Field of Classification Search

USPC ..... 283/86, 903; 101/485–486

See application file for complete search history.

(56) References Cited

U.S. PATENT DOCUMENTS

| | | | | |
|---|---|---|---|---|
| 5,776,286 | A | 7/1998 | Yeh et al. | |
| 5,889,598 | A | 3/1999 | Monaghan | |
| 6,308,630 | B1 * | 10/2001 | Kurokawa et al. | 156/235 |
| 6,737,139 | B2 | 5/2004 | Sidney et al. | |
| 2006/0006639 | A1 | 1/2006 | Taylor et al. | |
| 2006/0098005 | A1 | 5/2006 | Yung | |
| 2009/0298567 | A1 * | 12/2009 | Grotkowski et al. | 283/903 |

OTHER PUBLICATIONS

U.S. Appl. No. 61/057,908, filed Jun. 2, 2008.*

* cited by examiner

*Primary Examiner* — Kyle Grabowski

(74) *Attorney, Agent, or Firm* — McCormick Paulding & Huber LLP

(57) ABSTRACT

A method of creating a substrate containing multiple holographic images. The method includes dividing the substrate into a plurality of equally sized print surfaces and placing a holographic image on each of the print surfaces. Wherein the holographic image is placed at substantially the same location on each of the print surfaces.

4 Claims, 2 Drawing Sheets

PRINTER REGISTER HOLOGRAPHIC IMAGES

CROSS REFERENCE TO RELATED APPLICATION

This application claims the benefit of U.S. Provisional Application Ser. No. 61/239,540, filed on Sep. 3, 2009, and herein incorporated by reference in its entirety.

FIELD OF THE INVENTION

The present invention relates generally to printer register holographic images and more specifically to creating sheets of multiple holographic images that are in printer register allowing for tighter print tolerances.

BACKGROUND OF THE INVENTION

Game tickets, such as scratch-off lottery tickets, are generally designed to be attractive to a potential purchaser. As will be appreciated, the more attractive a ticket is, the more likely it will be purchased. To enhance the desirability of game tickets, high-quality color graphics are often applied to the game face of a ticket.

More recently, lottery tickets have included holographic images to further increase their attractiveness and marketability. Such images may be created through the use of a transfer lamination process in which a metallized film is first bonded to a substrate, such as a paper board, and then, after a curing process, removed to leave the metal, i.e., the hologram, on the substrate. The metallized substrate may then be printed to create a lottery ticket.

Holograms used for game tickets are currently printed with a "wallpaper" pattern. That is, the hologram for a single game ticket includes a two-dimensional repetitive pattern that includes symmetrical elements. Such patterns are typically created on relatively large sheets that include enough substrate material for multiple tickets. These sheets are printed with the game data and scratch off layer, if present, and cut to form individual tickets.

While wallpaper hologram patterns are generally attractive and create salable tickets, they do not allow for the alignment of specific printed elements with corresponding holographic elements. For example, the alignment of a printed sun with a specific hologram sunburst pattern on the substrate is not possible using conventional wallpaper patterns.

As such, the use of wallpaper style holographic images to create lottery tickets provides only a limited range of potential designs. This is undesirable as ability to create new designs for lottery tickets increases the marketability of such tickets and the resulting revenue generated from sales of the tickets.

In view of the above, a need exists for printer register holographic images that allow printed elements can be precisely aligned with holographic elements on a substrate. As discussed in detail herein, the present invention addresses this need.

SUMMARY OF THE INVENTION

It is an object of the present invention to provide printer register holographic images.

It is an additional object of the present invention to provide printer register holographic images that allow for a range of potential designs presently unknown in the art.

It is an additional object of the present invention to provide printer register holographic images that allow for a range of potential lottery ticket designs presently unknown in the art.

It is an additional object of the present invention to provide printer register holographic images that allow for tighter print to register tolerances.

It is an additional object of the present invention to provide printer register holographic images that allow for tighter print to register tolerances and a range of potential designs unknown in the art, through the use of specific individual holographic design elements that are repeated at a specific and intended distance on a sheet of substrate containing multiple individual cards.

It is an additional object of the present invention to provide printer register holographic images that allow for tighter print to register tolerances, and a range of potential designs unknown in the art, through the use of markers to assist the printer in locating specific holographic design elements for printing.

These and other objects, features and advantages of the present invention will become apparent in light of the detailed description of the best mode embodiment thereof, as illustrated in the accompanying drawings.

An embodiment of the present invention is a method of creating a substrate containing multiple holographic images. The method includes dividing the substrate into a plurality of equally sized print surfaces and placing a holographic image on each of the print surfaces. Wherein the holographic image is placed at substantially the same location on each of the print surfaces.

An additional embodiment of the present invention is a method of printing a plurality of images on a substrate. The substrate has a plurality of print surfaces each containing at least one holographic image. The method includes sensing a location of the holographic image on the print surface. Printing an image on the print surface once the location has been determined. The printed image being at a fixed distance from the holographic image, the fixed distance being substantially the same for each print surface receiving a printed image.

Yet another embodiment of the present invention is a substrate for use in printing a plurality of game cards. The substrate includes a plurality of print surfaces on a side of the substrate, the print surfaces being of substantially equal size. The substrate further includes at least one holographic image on each of the print surfaces. Each holographic image is located in substantially the same location on each print surface.

DETAILED DESCRIPTION OF THE PREFERRED EMBODIMENT

Figure 1:
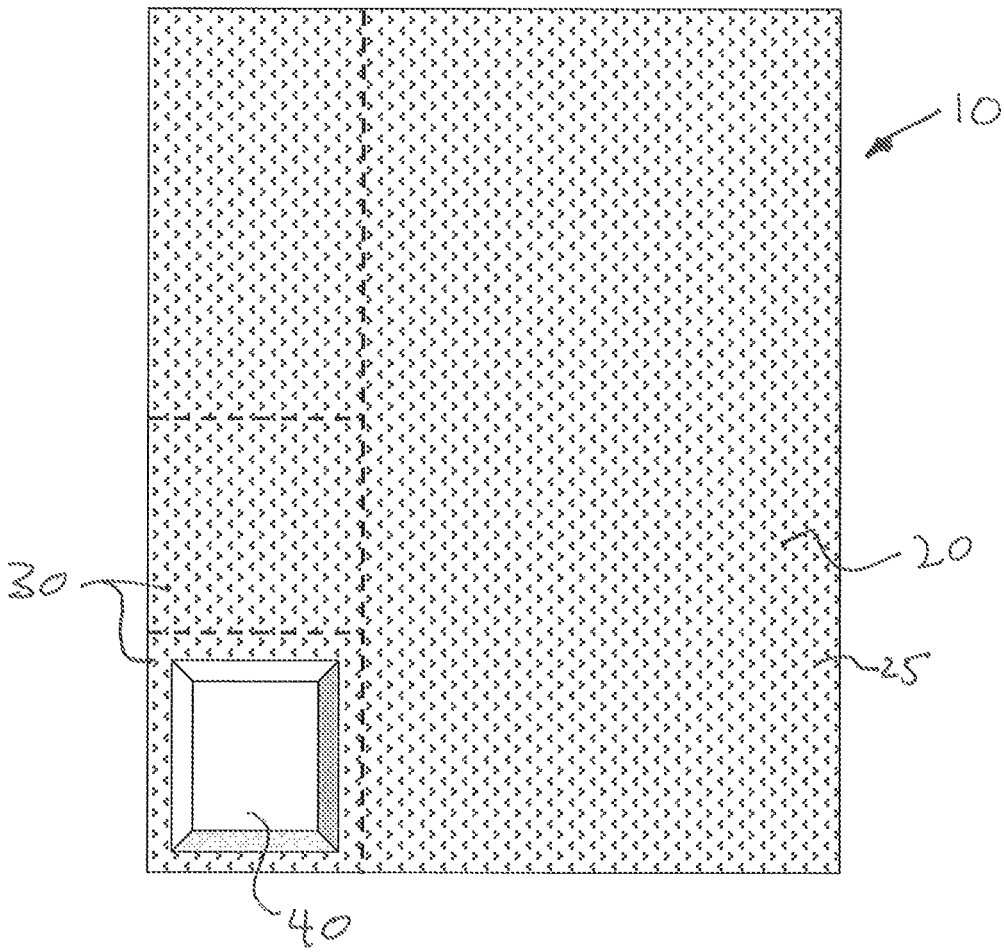
FIG. 1 PRIOR ART
FIG. 1 is a graphical illustration of prior art wallpaper style holographic images.

Referring to FIG. 1, known methods of generating holographic images for use with game cards involve the application of a wallpaper style holographic image to a paper substrate. The application of such an image is usually accomplished through a transfer lamination process in which a metallized film containing the holographic imagery is bonded to a substrate, cured and stripped away to leave the imagery on the substrate.

As shown, a relatively large sheet 10 that contains enough substrate material to yield multiple individual cards 30 is transfer laminated. The wallpaper style holographic images 20 include repeated two-dimensional design elements 25 which create a wallpaper pattern that is present on each individual card 30. Score lines, perforations and the like may be used to delineate individual cards 30 if desired.

Once the holographic images 20 have been applied to the substrate, the other design elements 40, e.g., the graphics, title and scratch off layer, are printed over the wallpaper patterned holographic imagery 20 to result in a completed game card. The completed game card is then distributed and sold.

With these known methods, the design elements 40 are printed without regard to the location of specific holographic design elements 25. This is a result of the repetitive wallpaper pattern 20 that is devoid of individual, i.e., non-repetitive, design elements placed at specific locations on each card, and also the inability to precisely locate a printed design element with a holographic design element.

As stated, the use of wallpaper patterned holographic imagery constrains the design of lottery tickets as one cannot precisely locate print elements with respect to specific holographic elements. The present invention addresses this issue as described in greater detail below.

Figure 2:
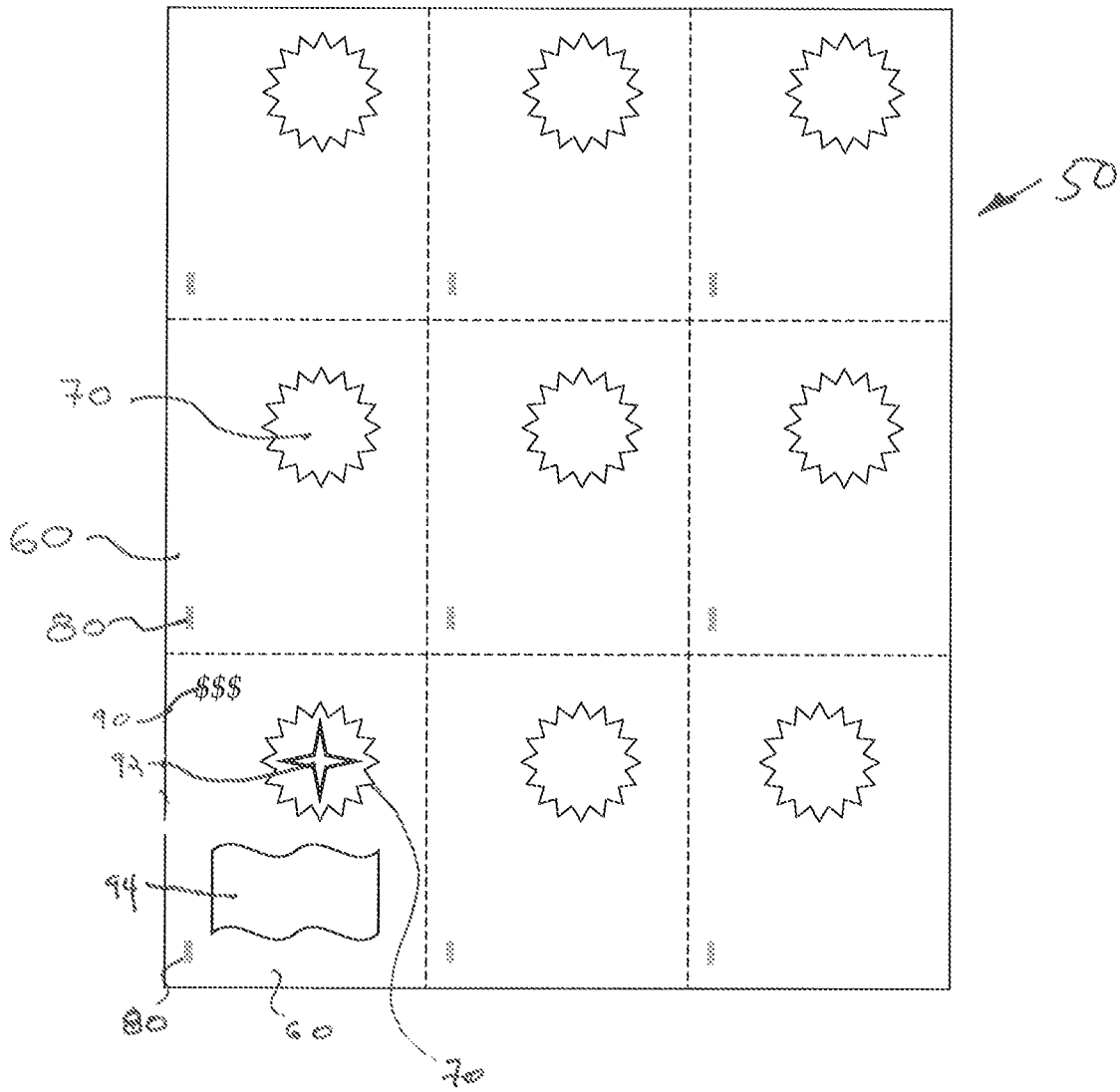
FIG. 2 is a graphical illustration of a sheet of substrate containing printer register holographic images in accordance with an embodiment of the present invention.

Turning now to FIG. 2, the inventive printer register holographic images are also applied to relatively large sheets of substrate 50 containing multiple print surfaces that yield multiple cards. The inventive holographic images may also be applied through a transfer lamination process in which a metallized film containing the holographic images is bonded to a substrate, cured and then stripped away leaving the image on the substrate. Preferably, the resulting substrate/metallized film is then rolled for distribution to a printer to create the printed design elements.

Importantly, the inventive holographic images are not in a conventional wallpaper pattern but contain individual design elements 70 that are repeated at a specific distance so that the elements 70 are in the same location on each individual card/print surface 60.

The ability to precisely locate individual holographic design elements 70 on a ticket is an important aspect of the present invention. As will be appreciated, by placing individual holographic design elements in a predeteremined location on a ticket, one is able to print a graphic or text, i.e., a printed image, in a location proximate or relative to the holographic element. This facilitates the creation of a wider range of possible graphic designs for lottery tickets than is presently available with wallpaper-style holographic imagery. The greater the range of designs, in turn, increases the marketability and sales of lottery tickets.

The location and spacing of the individual holographic design elements 70 can vary depending on the desired look of the ticket. For example, the holographic design elements 70 may be spaced apart by 40 inches so that there is one element 70 per ticket 60.

The inventive holographic film also includes markers 80 or "I-marks". The markers 80 are at a fixed distance from the specific holographic imagery 70 and assist the printer in printing in register with the imagery 70. The markers 80 are generally configured with one marker 80 per lottery ticket 60. It may be possible, however, to use more than (or fewer than) one marker per ticket. Moreover, the markers 80 are depicted in a specific shape but, as will be appreciated, other markers may be employed.

It is anticipated that the markers 80 will be scanned or read by an optical sensor that is in operative association with a printer. In operation, the sensor shines a beam of light onto the paper and assesses the contrasting reflectivity at predetermined positions on the sheet to detect the position of the holographic images on the substrate.

The markers 80 are another important aspect of the present invention as they allow printers to locate and print images in register with holographic design elements present on the substrate. As mentioned, this allows for a greater range of potential ticket designs, which increases marketability and sales of such tickets.

In particular, using the markers 80, printed design elements 90, 92, 94 can be printed in register with specific holographic design elements, such as the depicted sun design 70, to create unique, marketable designs not presently possible with wallpaper style holographic imagery. In the depicted example, a decorative printed element 92 is located within the holographic sun design 70. Other printed elements 90, 94 are printed on the ticket 60 at pre-selected distances from the holographic sun design 70.

In sum, the inventive holographic images are in printer register through the use of uniformly spaced holographic imagery and markers. This provides a wider range of potential designs and a cost savings that are currently unavailable with known imagery and processes.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A method of creating a substrate containing multiple holographic images, said method comprising the steps of:

dividing said substrate into a plurality of equally sized print surfaces, said print surfaces being individual lottery game cards;

determining a registration location on each of said print surfaces, said registration location defining a location of a holographic image on each of said print surfaces;

placing said holographic image and a marker on each of said print surfaces of said substrate though a transfer lamination process wherein a film having said holographic image and a marker at a fixed distance from said holographic image is bonded to said substrate, cured and stripped to leave said holographic image and said marker on each of said print surfaces of said substrate; and printing a design element on said substrate in registration with said holographic image after said holographic image and said marker are applied to said substrate through said transfer lamination process;

wherein said holographic image is placed on each of said print surfaces at said determined registration locations;

wherein said marker is different than and spaced from said holographic image; and wherein said holographic image is placed at substantially the same location on each of said print surfaces.

2. The method of claim 1, wherein said substrate is divided into a plurality of equally sized print surfaces by score lines between said print surfaces so that print surfaces may be easily detached from said substrate.

3. A method of printing a plurality of images on a substrate, said substrate having a plurality of print surfaces each containing at least one holographic image, said method comprising the steps of:

placing said holographic image and a marker on each of said print surfaces of said substrate through a transfer lamination process;

sensing a location of said holographic image on said print surface in two dimensions by detecting said marker on said print surface, said marker being different than and spaced from said holographic image; and printing an image on said print surface of said substrate after said holographic image and said marker are placed on said substrate through said transfer lamination process and once said location has been determined;

wherein said printed image is at a fixed distance from said holographic image, said fixed distance being substantially the same for each print surface receiving said printed image;

wherein each of said at least one holographic image is registered with respect to said print surfaces; and wherein said print surfaces are individual lottery game cards.

4. The method of claim 3, wherein an optical sensor is used to detect said marker on said print surface.

* * * * *